US006885259B2

(12) United States Patent
Lee et al.

(10) Patent No.: US 6,885,259 B2
(45) Date of Patent: Apr. 26, 2005

(54) MATCHING CIRCUIT AND LAMINATED DUPLEXER WITH THE MATCHING CIRCUIT

(75) Inventors: Byoung Hwa Lee, Kyungki-do (KR); Nam Chul Kim, Daejeon (KR); James Mike Peters, Frederick, MD (US); Myung Pyo Jun, Kyungki-do (KR); Jeong Ho Yoon, Kyungki-do (KR); Ian Lee, Seoul (KR); Dong Seok Park, Seoul (KR); Sang Soo Park, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 86 days.

(21) Appl. No.: 10/623,594

(22) Filed: Jul. 22, 2003

(65) Prior Publication Data

US 2004/0227584 A1 Nov. 18, 2004

(30) Foreign Application Priority Data

May 14, 2003 (KR) ..... 10-2003-0030514

(51) Int. Cl.[7] ..... H01P 1/213

(52) U.S. Cl. ..... 333/126; 333/129; 333/132; 333/134

(58) Field of Search ..... 333/126, 129, 333/132, 134

(56) References Cited

U.S. PATENT DOCUMENTS 5,525,942 A * 6/1996 Horii et al. ..... 333/134

6,414,567 B1 * 7/2002 Matsumura et al. ..... 333/134

FOREIGN PATENT DOCUMENTS

JP 2002-164710 6/2002

* cited by examiner

*Primary Examiner*—Anh Q. Tran
(74) *Attorney, Agent, or Firm*—Lowe Hauptman & Berner, LLP

(57) ABSTRACT

Disclosed is a matching circuit of a laminated duplexer connected to an antenna terminal while being connected between transmitting and receiving filters to match the transmitting and receiving filters with the antenna terminal, the matching circuit being configured to reduce the physical length of each conductor pattern thereof, thereby being capable of achieving an improved miniaturization thereof. The matching circuit includes a transmitting matching unit constituted by a conductor pattern electrically connected to an antenna electrode connected to the antenna terminal while being electrically connected to the transmitting filter, a first ground electrode vertically spaced apart from the conductor pattern, a receiving matching unit constituted by a conductor pattern electrically connected to the antenna electrode and the receiving filter, and a second ground electrode vertically spaced apart from the conductor pattern of the receiving matching unit. A laminated duplexer provided with the matching circuit is also disclosed. In accordance with the configuration of the matching circuit, it is possible to achieve a reduction in insertion loss, an improvement in the reflection characteristics of an associated antenna, and, thus, an improvement in bandpass characteristics.

24 Claims, 10 Drawing Sheets

MATCHING CIRCUIT AND LAMINATED DUPLEXER WITH THE MATCHING CIRCUIT

BACKGROUND OF THE INVENTION

1. Field of the Invention

The present invention relates to a laminated duplexer applicable to mobile communication terminals such as mobile phones, and more particularly to a matching circuit for performing matching of characteristic impedance between an antenna terminal and each of transmitting and receiving terminals, and isolation between transmitting and receiving frequencies, which matching circuit is configured to reduce the physical length of its conductor pattern, thereby being capable of achieving an improved miniaturization thereof, a reduction in insertion loss, an improvement in the reflection characteristics of an associated antenna, and, thus, an improvement in bandpass characteristics, and a laminated duplexer with the matching circuit.

2. Description of the Related Art

Generally, integrated duplexers of a bulk type have a drawback in that it is difficult to reduce the size thereof, even though they are superior in terms of performance. Although SAW duplexers can achieve miniaturization, there are drawbacks in that they have a low power capacity and a high sensitivity to humidity and temperature while being relatively expensive, as compared to the bulk type integrated duplexers. On the other hand, laminated duplexers can achieve miniaturization while being sufficiently competitive in terms of the manufacturing costs. The laminated duplexers are superior over the SAW duplexers in terms of power capacity, while having a high resistance to humidity and temperature. Of course, the laminated duplexers exhibit an inferior performance to the bulk type integrated duplexers or SAW duplexers. For this reason, active research for improving the performance of such laminated duplexers is being conducted.

If good results are obtained from the research for improving the performance of laminated duplexers, it may then be expected that the laminated duplexers will replace the bulk type integrated duplexers or SAW duplexers.

In order to achieve an improvement in the performance of such laminated duplexers, it is necessary to mainly conduct research with respect to the following factors:

(1) Material: Low temperature cofired ceramic (LTCC) of an intermediate dielectric constant (relative dielectric constant≈20~100) having a high Q value (>1,500);

(2) Electrode: Electrode material having a high conductivity (>$4.83\times10^7$ simens/m);

(3) Resonator Structure: Resonator structure having a Qu value; and (4) Matching Circuit: Matching circuit has to completely isolate transmitting and receiving filters from each other while minimizing a possible degradation in the transmitting and receiving filters.

FIG. 1 is a block diagram illustrating the basic configuration of a general duplexer. As shown in FIG. 1, such a duplexer mainly includes a transmitting filter, a receiving filter, and a matching circuit for coupling the filters. The matching circuit serves to minimize interference between the transmitting and receiving filters caused by the coupling of those filters. Accordingly, the matching circuit should be designed to minimize the influence thereof on the electrical characteristics of the transmitting and receiving filters, for example, insertion loss.

An example of conventional laminated duplexers is disclosed in Japanese Patent Laid-open Publication No. 2002-164710. The disclosed laminated duplexer will now be described with reference to FIGS. 2 to 4.

FIG. 2 is a perspective view illustrating the conventional laminated duplexer represented by the reference character A. Referring to FIG. 2, "1" represents a dielectric (laminate), "2*a*" and "2*b*" ground electrodes, "3" strip lines, that is, strip lines 30 to 35, "4" an inner wiring terminal, "5" a transmitting filter, "6" a receiving terminal, and "7" a matching circuit.

The laminate 1 consists of a plurality of laminated dielectric layers 1*a*. For the material of the laminate 1, a mixture of a dielectric ceramic material and a low temperature firing oxide or a low melting point glass material may be used. The dielectric ceramic material may include BaO—$TiO_2$-based ceramic, Ca—$TiO_2$-based ceramic, MgO—$TiO_2$-based ceramic, etc. The low temperature firing oxide may include $BiVO_4$, CuO, $Li_2O$, $B_2O_3$, etc. For miniaturization of the matching circuit and filters, it is necessary to use a high dielectric constant material having a relative dielectric constant of, for example, 15 to 25. Each dielectric layer 1*a* has a thickness of about 50 to 3,000 $\mu$m.

The ground electrodes 2*a* are formed at upper and lower surfaces of the laminate 1, respectively, whereas the ground electrodes 2*b* are formed at side surfaces of the laminate 1, respectively. Each ground electrode 2*a* or 2*b* is made of a conductor material containing, as a major component thereof, Ag and Cu (Ag group, Ag alloy such as Ag—Pd or Ag—Pt, Cu monomer, or Cu alloy).

FIG. 3 is an enlarged view illustrating a part of the matching circuit shown in FIG. 2. FIG. 4 is an equivalent circuit diagram of the receiving filter and matching circuit shown in FIG. 2.

Referring to FIGS. 3 and 4, the matching circuit 7 has a T-shaped circuit structure including a capacitor C2 formed between capacitor electrodes 4*b* and 4*c* connected to an antenna terminal 42 of the receiving filter 6 in series, a capacitor C0 formed between an edge-side strip line of the receiving filter 6, that is, the strip line 32, and a capacitor electrode 4*d* facing the strip line 32, and an inductor L1 formed of a coil 400. In the matching circuit 7 having such a configuration, the impedance characteristics of the receiving filter 6 are adjusted in accordance with the phase characteristics of a capacitor Ci formed between the capacitor electrode 4*d* and a main strip line portion 32*a* of the strip line 32, in order to achieve desired matching. The coil 400 includes bent electrodes 41*a* to 41*c*, and via holes 42*a* to 42*c*.

Since the matching circuit 7 of the above mentioned conventional laminated duplexer has a coil formed to have a spiral shape in the dielectric, using a plurality of bent electrodes and via holes, it can achieve miniaturization.

That is, where the matching circuit of the conventional laminated duplexer has a spiral coil, as mentioned above, it is possible to reduce the coil size in a longitudinal direction. However, the coil increases in size in a thickness direction correspondingly to the reduction in the longitudinal size, so as to provide a desired electrical length required in the matching circuit, even though the increase in thickness may vary more or less in accordance with a variation in the spiral shape of the coil. For this reason, there is a limitation on the miniaturization in both the longitudinal direction and the thickness direction.

Thus, only a limited miniaturization is achieved where the coil of the matching circuit is simply formed to have a spiral shape or formed using bent electrodes in order to miniaturize the duplexer applicable to a mobile communication terminal such as a mobile phone while maintaining the electrical length required in the matching circuit. Accordingly, it is necessary to research and develop a new laminated duplexer capable of overcoming the limitation.

SUMMARY OF THE INVENTION

The present invention has been made in view of the above mentioned problems, and an object of the invention is to provide a matching circuit for performing matching of characteristic impedance between an antenna terminal and each of transmitting and receiving terminals, and isolation between transmitting and receiving frequencies, which matching circuit is configured to reduce the physical length of its conductor pattern, thereby being capable of achieving an improved miniaturization thereof, a reduction in insertion loss, an improvement in the reflection characteristics of an associated antenna, and, thus, an improvement in bandpass characteristics, and a laminated duplexer with the matching circuit.

In accordance with one aspect, the present invention provides a matching circuit of a laminated duplexer made of a plurality of dielectric layers, and connected to an antenna terminal while being connected between transmitting and receiving filters to match the transmitting and receiving filters with the antenna terminal, comprising: a transmitting matching unit constituted by a first conductor pattern electrically connected to an antenna electrode coupled to the antenna terminal while being electrically connected to the transmitting filter; a first ground electrode vertically spaced apart from the first conductor pattern by a certain distance; a receiving matching unit constituted by a second conductor pattern electrically connected to the antenna electrode and the receiving filter; and a second ground electrode vertically spaced apart from the second conductor pattern.

In accordance with another aspect, the present invention provides a laminated duplexer provided with the matching circuit.

BRIEF DESCRIPTION OF THE DRAWINGS

The above objects, and other features and advantages of the present invention will become more apparent after a reading of the following detailed description when taken in conjunction with the drawings, in which:

FIGS. 9*a* and 9*b* are equivalent circuit diagrams of matching circuits, respectively, wherein FIG. 9*a* illustrates a matching circuit consisting of a single strip line, whereas FIG. 9*b* illustrates a matching circuit consisting of a strip line, and capacitors respectively connected to both sides of the strip line.

DESCRIPTION OF THE PREFERRED EMBODIMENTS

Figure 1:
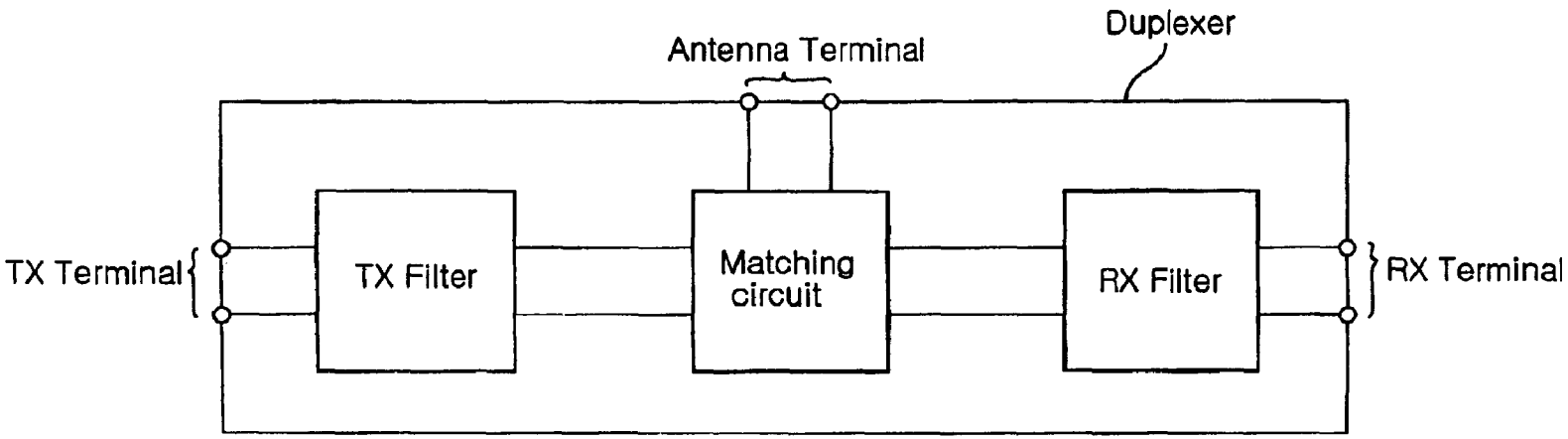
PRIOR ART FIG. 1
FIG. 1 is a block diagram illustrating the basic configuration of a general duplexer.
Figure 2:
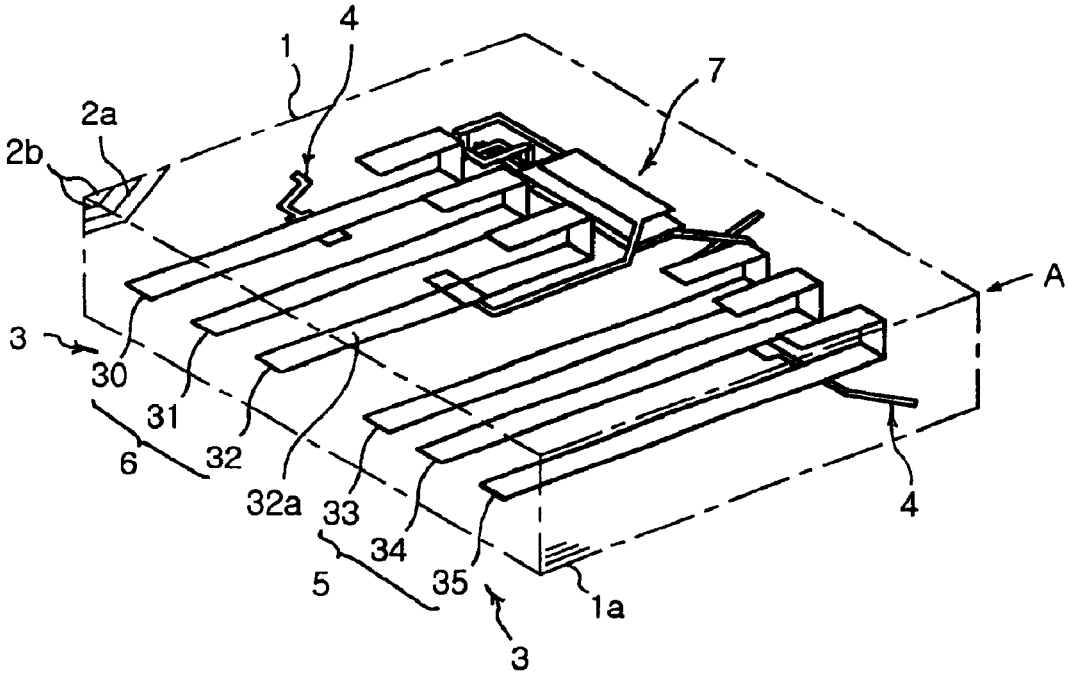
PRIOR ART FIG. 2
FIG. 2 is a perspective view illustrating the conventional laminated duplexer.
Figure 3:
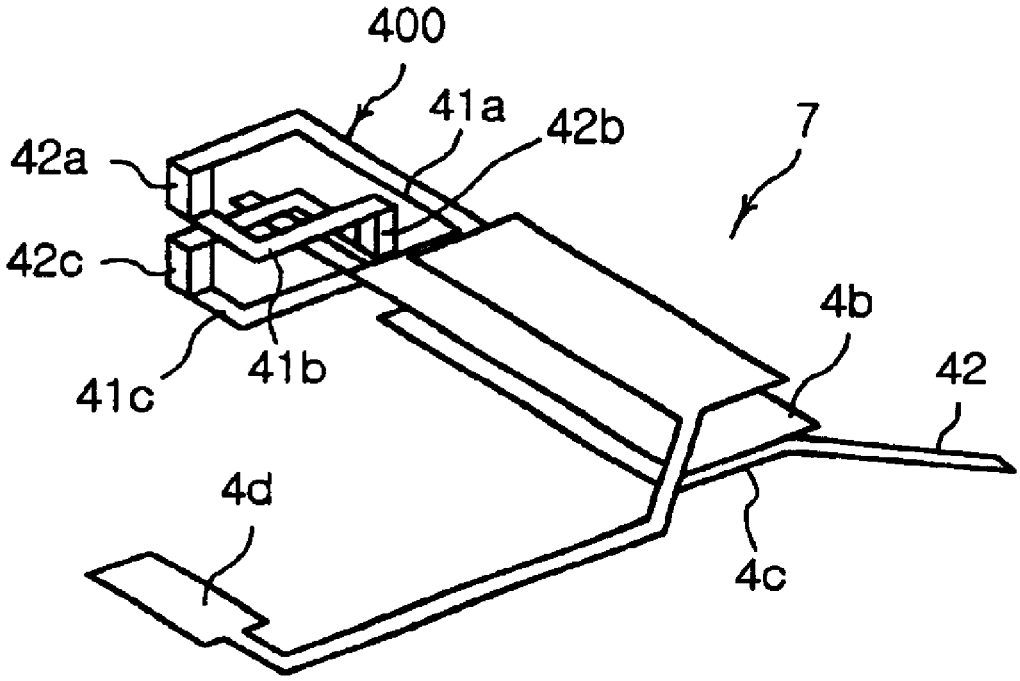
PRIOR ART FIG. 3
FIG. 3 is an enlarged view illustrating a part of a matching circuit shown in FIG. 2.
Figure 4:
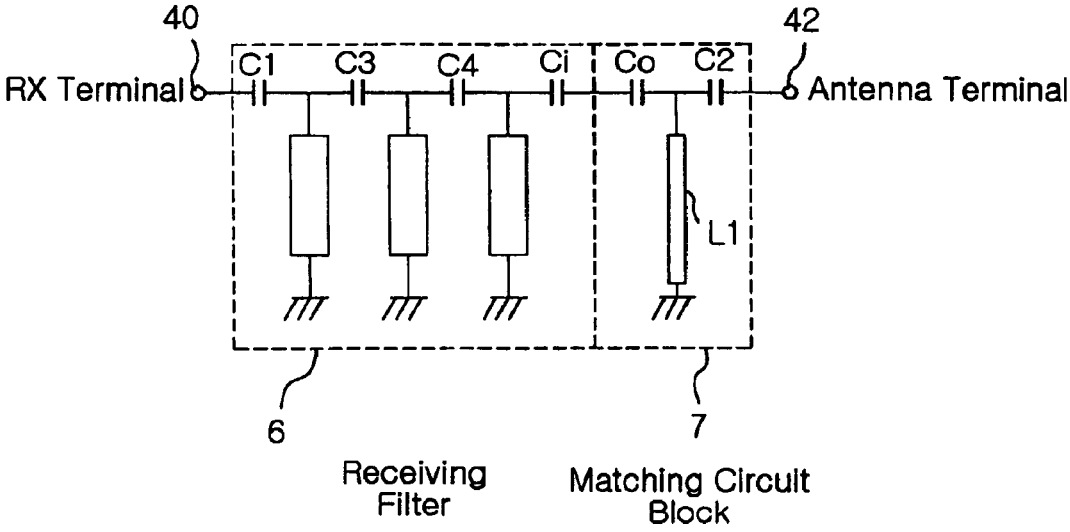
PRIOR ART FIG. 4
FIG. 4 is an equivalent circuit diagram illustrating a receiving filter and the matching circuit shown in FIG. 2.

Now, preferred embodiments of the present invention will be described in detail with reference to the annexed drawings. In the drawings, constitutive elements having the same configuration and function will be denoted by the same reference numeral.

Figure 5:
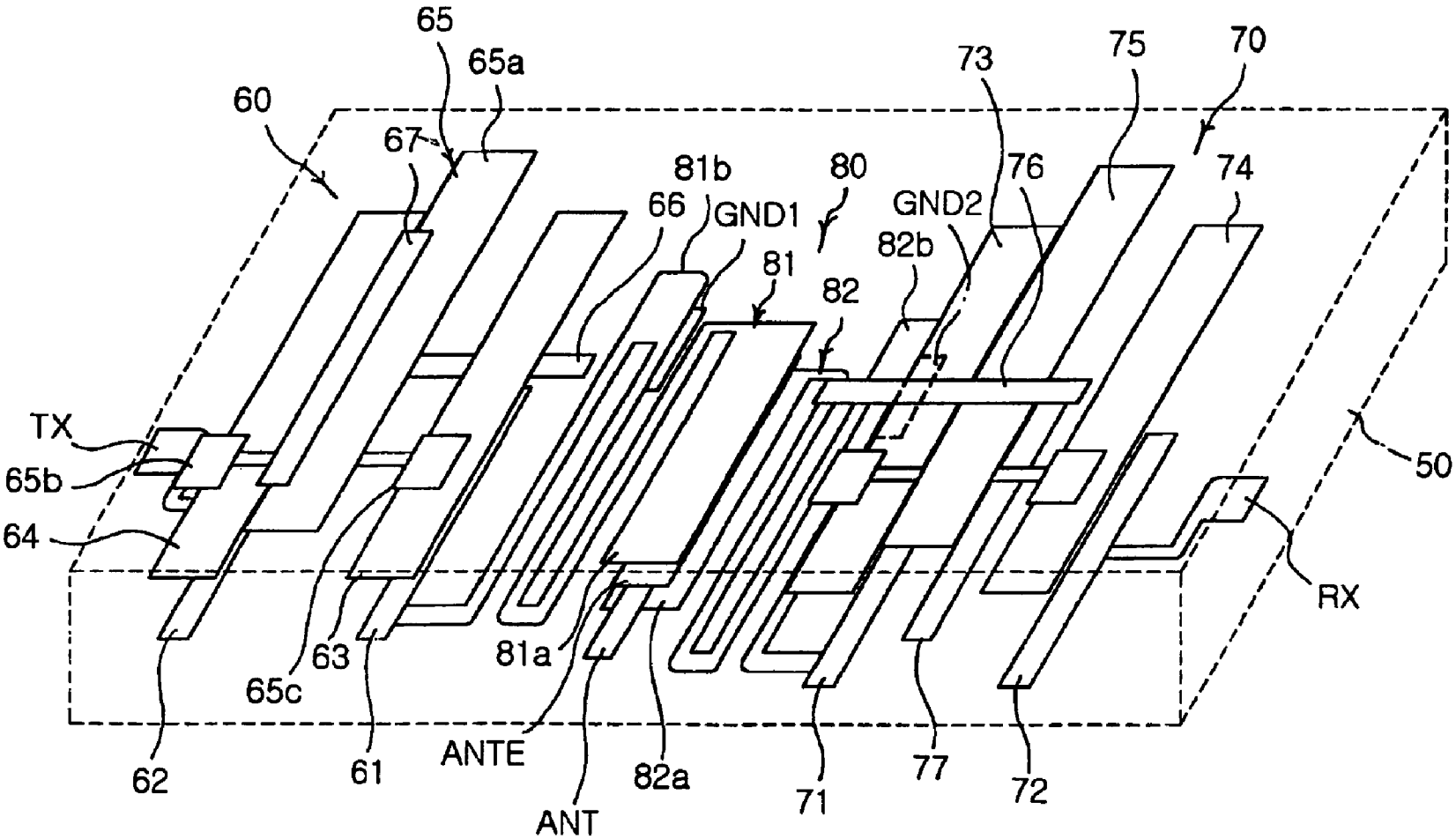
FIG. 5 is a schematic perspective view illustrating a laminated duplexer according to the present invention.
Figure 6:
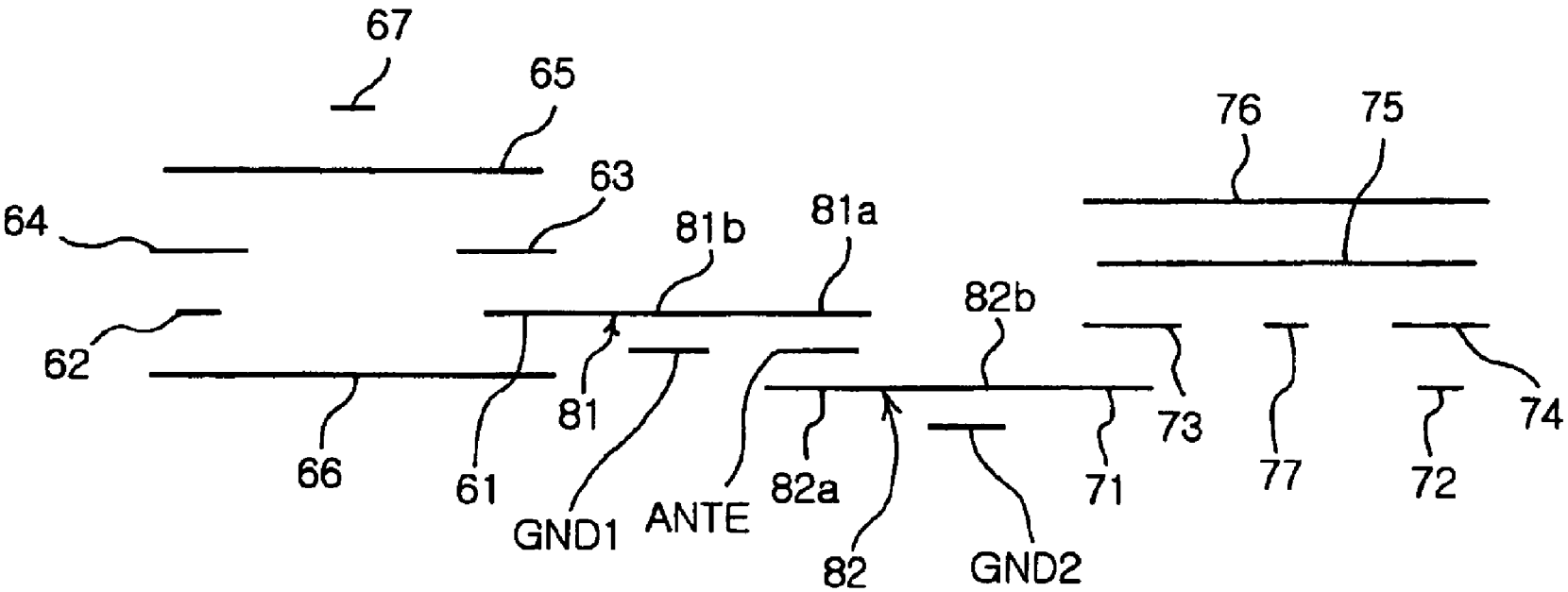
FIG. 6 is a schematic sectional view corresponding to FIG. 5.

FIG. 5 is a schematic perspective view illustrating a laminated duplexer according to the present invention. FIG. 6 is a schematic sectional view corresponding to FIG. 5.

Referring to FIGS. 5 and 6, the laminated duplexer of the present invention includes a plurality of dielectric layers laminated to form a dielectric block 50. The laminated duplexer is connected to an antenna terminal ANT while being connected between a transmitting terminal TX and a receiving terminal RX. The laminated duplexer also includes a transmitting filter 60 electrically connected to the transmitting terminal TX while including a plurality of resonating strip lines for passing signals of a transmitting frequency therethrough, a receiving filter 70 electrically connected to the receiving terminal RX while including a plurality of resonating strip lines for passing signals of a receiving frequency therethrough, and a matching circuit 80 for matching the transmitting and receiving filters 60 and 70 with an antenna connected to the antenna terminal ANT.

Figure 7:
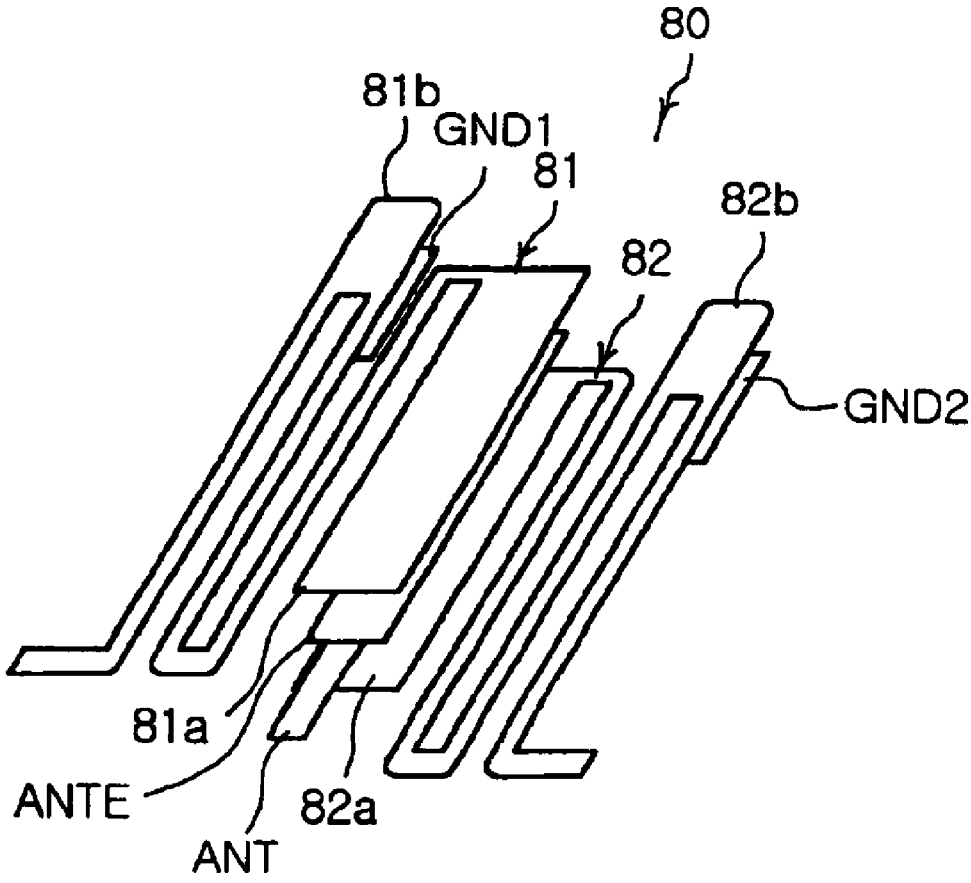
FIG. 7 is a schematic enlarged view illustrating the structure of a matching circuit shown in FIG. 5.

FIG. 7 is a schematic enlarged view illustrating the structure of the matching circuit shown in FIG. 5. As shown in FIG. 7, the matching circuit 80 performs matching of characteristic impedance Zo (about 50 ω) between the transmitting filter 60 and the antenna terminal ANT, matching of the characteristic impedance Zo between the receiving filter 70 and the antenna terminal ANT, and isolation between the transmitting and receiving frequencies by cutting off the receiving frequency at the transmitting filter 60 while cutting off the transmitting frequency at the receiving filter 70.

Referring to FIGS. 5 to 8, the matching circuit 80 includes a transmitting matching unit 81 constituted by a conductor pattern electrically connected to an antenna electrode ANTE coupled to the antenna terminal ANT while being electrically connected to the transmitting filter 60, a first ground electrode GND1 vertically spaced apart from the conductor pattern of the transmitting matching unit 81 by a certain distance, a receiving matching unit 82 constituted by a conductor pattern electrically connected to the antenna electrode ANTE and receiving filter 70, and a second ground electrode GNb2 vertically spaced apart from the conductor pattern of the receiving matching unit 82.

The conductor pattern of the transmitting matching unit 81 includes a transmitting-side capacitor electrode 81*a* spaced apart from the antenna electrode ANTE by a certain distance to form a first capacitance C81 for adjustment of characteristic impedance Zo therebetween, and a transmitting-side strip line 81*b* extending from the transmitting-side capacitor electrode 81*a* to the transmitting filter 60 while having a bent shape, and forming a first inductance L81. The transmitting-side strip line 81*b* may have a shape other than the bent shape, for example, a spiral shape.

Using the first capacitance C81, control of characteristic impedance can be achieved, as described above.

Accordingly, high dielectric constant materials can be used for the dielectric layers. As a result, it is possible to reduce insertion loss generated at the transmitting and receiving filters.

The first ground electrode GND1 is spaced apart from the transmitting-side strip line 81*b* of the transmitting matching unit 81 by a certain distance, so that first phase-adjusting capacitances C83*a* and C83*b* are formed between the first ground electrode GND1 and the transmitting-side strip line 81*b*.

The first inductance L81 and first phase-adjusting capacitances C83*a* and C83*b* have electrical lengths set to transform the phase of a signal having the receiving frequency into infinite impedance. In accordance with this phase transforming function, the receiving-frequency signal can be cut off. In accordance with the addition of the first phase-adjusting capacitances C83*a* and C83*b*, it is possible to reduce the physical length of the transmitting-side strip line 81*b*. This will be described with reference to FIGS. 9*a* and 9*b*, hereinafter.

The characteristic impedance of the transmitting matching unit 81, that is, the characteristic impedance Zo, is determined for the transmitting frequency by equivalent impedances of the first inductance L81, first capacitance C81, and first phase-adjusting capacitances C83*a* and C83*b*. Here, this characteristic impedance Zo can be easily adjusted in accordance with adjustment of the first capacitance C81 formed between the conductor pattern of the transmitting matching unit 81 and the antenna electrode ANTE because the first capacitance C81 is varied depending on the distance between the conductor pattern and the antenna electrode ANTE, and the area of the antenna electrode ANTE.

Referring to FIGS. 5 and 6, the transmitting filter 60 includes a first capacitor electrode 61 formed at one end of the transmitting-side strip line 81*b* in the transmitting matching unit 81, a second capacitor electrode 62 connected to the transmitting terminal TX, a first resonating strip line 63 spaced apart from the first capacitor electrode 61 by a certain distance, a second resonating strip line 64 spaced apart from the second capacitor electrode 62 by a certain distance, and a third resonating strip line 65 spaced apart from the first and second resonating strip lines 63 and 64 by certain distances, respectively.

The transmitting filter 60 further includes a first cross coupling line 66 spaced apart from the first and second capacitor electrodes 61 and 62 by certain distances, respectively, and a first loading electrode 67 spaced apart from the third resonating strip line 65 by a certain distance.

Referring to FIGS. 6 and 7, the conductor pattern of the receiving matching unit 82 includes a receiving-side capacitor electrode 82*a* spaced apart from the antenna electrode ANTE by a certain distance to form a second capacitance C82 for adjustment of characteristic impedance Zo therebetween, and a receiving-side strip line 82*b* extending from the receiving-side capacitor electrode 82*a* to the receiving filter 70 while having a bent shape, and forming a second inductance L82. The receiving-side strip line 82*b* may have a shape other than the bent shape, for example, a spiral shape.

The second ground electrode GND2 is spaced apart from the receiving-side strip line 82*b* of the receiving matching unit 82 by a certain distance, so that second phase-adjusting capacitances C84*a* and C84*b* are formed between the second ground electrode GND2 and the receiving-side strip line 82*b*.

The second inductance L82 and second phase-adjusting capacitances C84*a* and C84*b* have electrical lengths set to transform the phase of a signal having the transmitting frequency into infinite impedance. In accordance with this phase transforming function, the transmitting-frequency signal can be cut off. In accordance with the addition of the second phase-adjusting capacitances C84*a* and C84*b*, it is possible to reduce the physical length of the receiving-side strip line 82*b*. This will be described with reference to FIGS. 9*a* and 9*b*, hereinafter.

The characteristic impedance of the receiving matching unit 82, that is, the characteristic impedance Zo, is determined for the receiving frequency by equivalent impedances of the second inductance L82, second capacitance C82, and second phase-adjusting capacitances C84*a* and C84*b*. Here, this characteristic impedance Zo can be easily adjusted in accordance with adjustment of the second capacitance C82 formed between the conductor pattern of the receiving matching unit 82 and the antenna electrode ANTE because the second capacitance C82 is varied depending on the distance between the conductor pattern and the antenna electrode ANTE, and the area of the antenna electrode ANTE.

Referring to FIGS. 5 and 6, the receiving filter 70 includes a third capacitor electrode 71 formed at one end of the receiving-side strip line 82*b* in the receiving matching unit 82, a fourth capacitor electrode 72 connected to the receiving terminal RX, a fourth resonating strip line 73 spaced apart from the third capacitor electrode 71 by a certain distance, a fifth resonating strip line 74 spaced apart from the fourth capacitor electrode 72 by a certain distance, and a sixth resonating strip line 75 spaced apart from the fourth and fifth resonating strip lines 73 and 74 by certain distances, respectively.

The receiving filter 70 further includes a second cross coupling line 76 spaced apart from the sixth strip resonating line 75 by a certain distance, and a second loading electrode 77 spaced apart from the sixth resonating strip line 75 by a certain distance.

Figure 8:
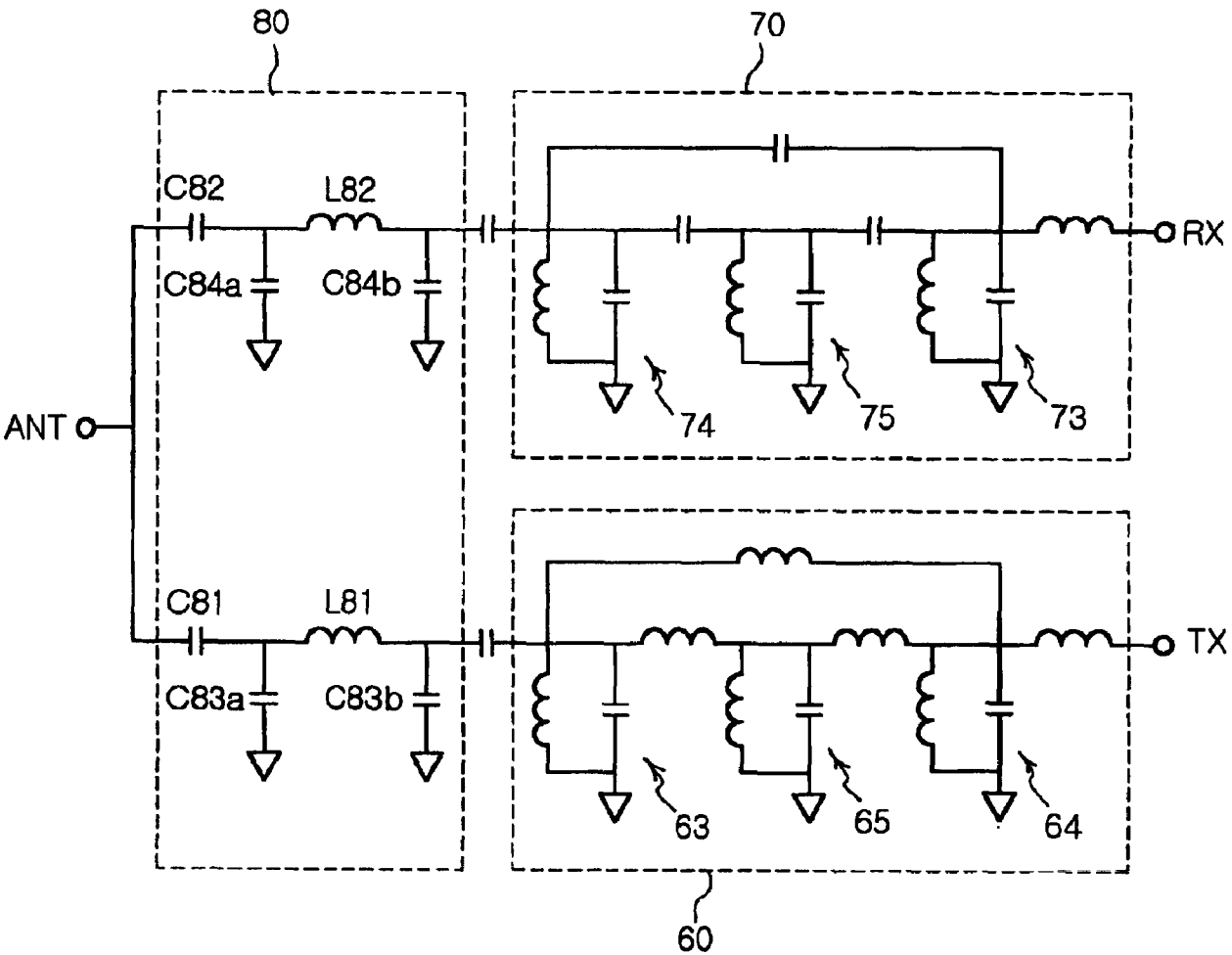
FIG. 8 is an equivalent circuit diagram of the laminated duplexer shown in FIG. 5.

FIG. 8 is an equivalent circuit diagram of the laminated duplexer shown in FIG. 5.

In FIG. 8, "60" represents the transmitting filter, "70" the receiving filter, and "80" the matching circuit. In the matching circuit 80 shown in FIG. 8, "L81" represents the inductance of the conductor pattern of the transmitting matching unit 81, "C81" represents the first capacitance formed between the antenna electrode ANTE and the receiving capacitor electrode 81*a*, and "C83*a*" and "C83*b*" respective capacitances formed between the conductor pattern of the transmitting matching unit 81 and the first ground electrode GND1.

Also, "L82" represents the inductance of the conductor pattern of the receiving matching unit 82, "C82" represents the second capacitance formed between the antenna electrode ANTE and the receiving capacitor electrode 82*a*, and "C84*a*" and "C84*b*" respective capacitances formed between the conductor pattern of the receiving matching unit 82 and the second ground electrode GND2.

Now, the technical background of why it is possible to obtain a desired electrical length while reducing the physical length of the transmitting or receiving strip line in accordance with the addition of capacitors to the transmitting or receiving strip line will be described with reference to FIGS. 9*a* and 9*b*.

Figure 9A:
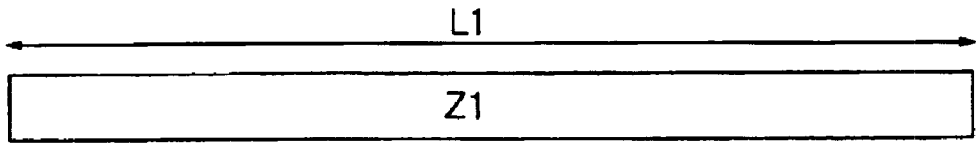
Figure 9B:
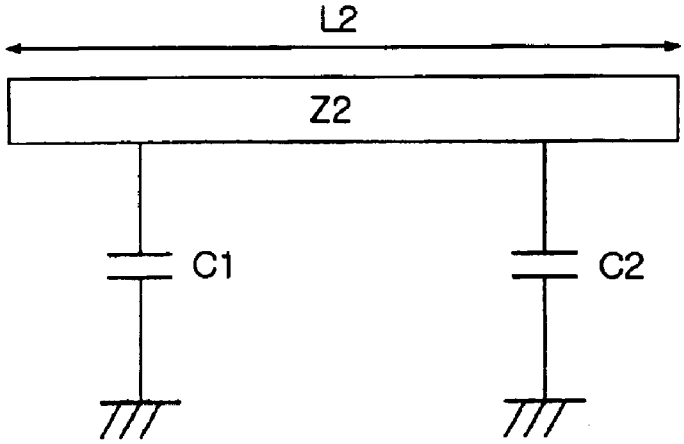

FIGS. 9*a* and 9*b* are equivalent circuit diagram of matching circuits, respectively, wherein FIG. 9*a* illustrates a matching circuit consisting of a single strip line, whereas FIG. 9*b* illustrates a matching circuit consisting of a strip line, and capacitors respectively connected to both sides of the strip line.

The matching circuit of FIG. 9*a* consisting of a single strip line can be expressed in the form of an ABCD matrix, as follows:

$$\begin{bmatrix} \cos\beta L1 & jZ1\sin\beta L1 \\ j\frac{\sin\beta L1}{Z1} & \cos\beta L1 \end{bmatrix} \quad \text{[Expression 1]}$$

In Expression 1, "β" represents a phase constant.

The matching circuit of FIG. 9*b* consisting of a strip line and capacitors respectively connected to both sides of the strip line can be expressed in the form of an ABCD matrix, as follows:

$$\begin{bmatrix} \cos\beta L2 - \omega CZ2\sin\beta L2 & jZ2\sin\beta L2 \\ j\frac{\sin\beta L2}{Z2} + 2j\omega C\cos\beta L2 - j(\omega C)^2 Z2\sin\beta L2 & \cos\beta L2 - \omega CZ2\sin\beta L2 \end{bmatrix} \quad \text{[Expression 2]}$$

In Expression 2, "β" represents a phase constant.

Where the ABCD matrixes of the circuits shown in FIG. 9*a* and FIG. 9*b*, as expressed by Expressions 1 and 2, are identical, the circuits have the same electrical length because they are equivalent. For example, in the case of "L1=λ/4 (β=90°), the circuits are equivalent in so far as they satisfy the following Expression 3:

$$Z2 = \frac{Z1}{\sin(\beta L2)}, \quad C = \frac{\omega\cos(\beta L2)}{Z1} \quad \text{[Expression 3]}$$

The circuit of FIG. 9*b* satisfies Expression 3 in the case of "C1=C2=C". When Expression 3 is satisfied, the matrixes of Expressions 1 and 2 are identical. When it is desired to reduce the length "L2" to be half the length "L1", it is necessary to satisfy the condition of "L2=λ/8(λ=45°)" and the following Expression 4:

$$Z2 = Z1\sqrt{2}, \quad C = \frac{\omega}{Z1\sqrt{2}} \quad \text{[Expression 4]}$$

Referring to Expression 4, it can be understood that "L2", that is, the physical length of the strip line, can be controlled by varying "C" and "Z2" in a state in which "Z1" is fixed.

As described above with reference to FIGS. 9*a* and 9*b*, the matching circuit consisting of a long strip line is equivalent, at an optional frequency, to the matching circuit consisting of a short strip line, and capacitors respectively connected to both sides of the strip line while being grounded. Accordingly, the matching circuit 80, in which a capacitance is formed between the strip line and the ground in accordance with the present invention, can have a reduced physical length, as compared to the matching circuit consisting of a single strip line, while maintaining the same electrical length at an optional frequency, in accordance with the formation of the capacitance. Thus, it is possible to miniaturize the matching circuit, and the duplexer using the matching circuit.

Figure 10:
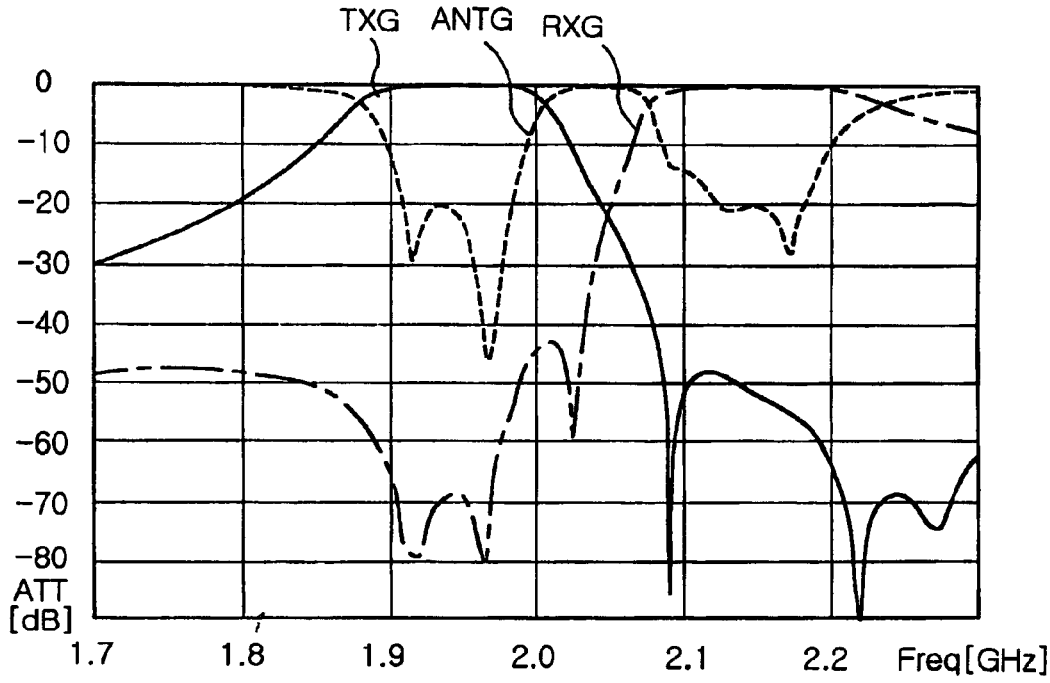
FIG. 10 shows graphs depicting the characteristics of the laminated duplexer according to the present invention.

FIG. 10 shows graphs depicting the characteristics of the laminated duplexer according to the present invention. The graphs of FIG. 10 are simulation results in the frequency bands of W-CDMA (TX: 1,920 to 1,980 MHz, and RX: 2,110–2,170 MHz). In FIG. 10, "TXG" is a graph depicting the pass characteristics of the laminated duplexer for the W-CDMA transmitting frequency band, "RXG" is a graph depicting the pass characteristics of the laminated duplexer for the W-CDMA receiving frequency band, and "ANTG" is a graph depicting the reflection characteristics of the laminated duplexer at its antenna terminal. Referring to the graph "TXG", it can be seen that the laminated duplexer passes the W-CDMA transmitting frequency band therethrough without any loss caused by reflection. It can also be seen that the laminated duplexer exhibits, at its antenna terminal, superior reflection characteristics for the W-CDMA transmitting frequency band. On the other hand, referring to the graph "RXG", it can be seen that the laminated duplexer passes the W-CDMA receiving frequency band therethrough without any loss caused by reflection. That is, the laminated duplexer exhibits superior reflection characteristics at its antenna terminal for both the frequency bands. The fact that superior reflection characteristics are obtained means that the interference between the transmitting and receiving frequency bands is minimized.

Thus, it is possible to use a material having a higher dielectric constant in laminated duplexers than those used in conventional cases in accordance with the present invention. In accordance with the present invention, it is also possible to reduce the physical length of the strip line used in the laminated duplexer. Accordingly, it is possible to minimize the insertion loss of the transmitting and receiving filters in the laminated duplexer caused by the matching circuit used in the laminated duplexer.

As apparent from the above description, the present invention provides a matching circuit for performing matching of characteristic impedance between an antenna terminal and each of transmitting and receiving terminals, and isolation between transmitting and receiving frequencies, which matching circuit is configured to reduce the physical length of its conductor pattern, thereby being capable of achieving an improved miniaturization thereof, a reduction in insertion loss, and, thus, miniaturization of a laminated duplexer and an improvement in the characteristics of the laminated duplexer.

The present invention also provides a laminated duplexer using low temperature co-fired ceramic (LTCC) which can be substituted for conventional bulk type integrated duplexers or conventional SAW duplexers. This laminated duplexer can also be configured to reduce the physical length of its matching circuit. Accordingly, it is possible to reduce insertion loss considered as the most significant problem in existing laminated duplexers. As the physical length of the matching circuit can be reduced, the laminated duplexer can be miniaturized. In accordance with addition of serial capacitors, high dielectric constant materials can be easily used because it is no longer required that the characteristic impedance of the strip line in the laminated duplexer be 50 ohms. Such a high dielectric constant material can contribute to reducing the insertion loss generated at transmitting and receiving filters.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A laminated duplexer made of a plurality of conductor patterns respectively formed on a plurality of dielectric layers, and connected to an antenna terminal while being connected between transmitting and receiving terminals, comprising:

a transmitting filter electrically connected to the transmitting terminal while including a plurality of resonating strip lines for passing signals of a transmitting frequency therethrough;

a receiving filter electrically connected to the receiving terminal while including a plurality of resonating strip lines for passing signals of a receiving frequency therethrough; and a matching circuit for matching the transmitting and receiving filters with the antenna terminal, the matching circuit including a transmitting matching unit constituted by a first one of the conductor patterns, the first conductor pattern being electrically connected to an antenna electrode coupled to the antenna terminal while being electrically connected to the transmitting filter, a first ground electrode vertically spaced apart from the first conductor pattern by a certain distance, a receiving matching unit constituted by a second one of the conductor patterns, the second conductor pattern being electrically connected to the antenna electrode and the receiving filter, and a second ground electrode vertically spaced apart from the second conductor pattern.

2. The laminated duplexer according to claim 1, wherein the first conductor pattern of the transmitting matching unit comprises:

a transmitting-side capacitor electrode spaced apart from the antenna electrode by a certain distance to form a first capacitance for adjustment of characteristic impedance therebetween; and a transmitting-side strip line extending from the transmitting-side capacitor electrode to the transmitting filter while having a bent shape, and forming a first inductance.

3. The laminated duplexer according to claim 2, wherein the first ground electrode is spaced apart from the transmitting-side strip line of the transmitting matching unit by a certain distance, so that first phase-adjusting capacitances are formed between the first ground electrode and the transmitting-side strip line.

4. The laminated duplexer according to claim 3, wherein the first inductance and the first phase-adjusting capacitances have electrical lengths set to transform a phase of a signal having the receiving frequency into infinite impedance, respectively.

5. The laminated duplexer according to claim 3, wherein the transmitting matching unit has characteristic impedance determined for the transmitting frequency by equivalent impedances of the first inductance, first capacitance, and first phase-adjusting capacitances.

6. The laminated duplexer according to claim 2, wherein the transmitting filter comprises:

a first capacitor electrode formed at one end of the transmitting-side strip line in the transmitting matching unit;

a second capacitor electrode connected to the transmitting terminal;

a first resonating strip line spaced apart from the first capacitor electrode by a certain distance;

a second resonating strip line spaced apart from the second capacitor electrode by a certain distance; and a third resonating strip line spaced apart from the first and second resonating strip lines by certain distances, respectively.

7. The laminated duplexer according to claim 6, wherein the transmitting filter further comprises a cross coupling line spaced apart from the first and second capacitor electrodes by certain distances, respectively.

8. The laminated duplexer according to claim 6, wherein the transmitting filter further comprises a loading electrode spaced apart from the third resonating strip line by a certain distance.

9. The laminated duplexer according to claim 1, wherein the second conductor pattern of the receiving matching unit comprises:

a receiving-side capacitor electrode spaced apart from the antenna electrode by a certain distance to form a second capacitance for adjustment of characteristic impedance therebetween; and a receiving-side strip line extending from the receiving-side capacitor electrode to the receiving filter while having a bent shape, and forming a second inductance.

10. The laminated duplexer according to claim 9, wherein the second ground electrode is spaced apart from the receiving-side strip line of the receiving matching unit by a certain distance, so that second phase-adjusting capacitances are formed between the second ground electrode and the receiving-side strip line.

11. The laminated duplexer according to claim 10, wherein the second inductance and the second phase-adjusting capacitances have electrical lengths set to transform the phase of a signal having the transmitting frequency into infinite impedance, respectively.

12. The laminated duplexer according to claim 10, wherein the receiving matching unit has characteristic impedance determined for the receiving frequency by equivalent impedances of the second inductance, second capacitance, and second phase-adjusting capacitances.

13. The laminated duplexer according to claim 9, wherein the receiving filter comprises:

a first capacitor electrode formed at one end of the receiving-side strip line in the receiving matching unit;

a second capacitor electrode connected to the receiving terminal;

a first resonating strip line spaced apart from the first capacitor electrode by a certain distance;

a second resonating strip line spaced apart from the second capacitor electrode by a certain distance; and a third resonating strip line spaced apart from the first and second resonating strip lines by certain distances, respectively.

14. The laminated duplexer according to claim 13, wherein the receiving, filter further comprises a cross coupling line spaced apart from the third strip resonating line by a certain distance.

15. The laminated duplexer according to claim 13, wherein the receiving filter further comprises a loading electrode spaced apart from the third resonating strip line by a certain distance.

16. A matching circuit of a laminated duplexer made of a plurality of dielectric layers, and connected to an antenna terminal while being connected between transmitting and receiving filters to match the transmitting and receiving filters with the antenna terminal, comprising:

a transmitting matching unit constituted by a first conductor pattern electrically connected to an antenna electrode coupled to the antenna terminal while being electrically connected to the transmitting filter;

a first ground electrode vertically spaced apart from the first conductor pattern by a certain distance;

a receiving matching unit constituted by a second conductor pattern electrically connected to the antenna electrode and the receiving filter; and a second ground electrode vertically spaced apart from the second conductor pattern.

17. The laminated duplexer according to claim 16, wherein the first conductor pattern of the transmitting matching unit comprises:

a transmitting-side capacitor electrode spaced apart from the antenna electrode by a certain distance to form a first capacitance for adjustment of characteristic impedance therebetween; and a transmitting-side strip line extending from the transmitting-side capacitor electrode to the transmitting filter while having a bent shape, and forming a first inductance.

18. The laminated duplexer according to claim 17, wherein the first ground electrode is spaced apart from the transmitting-side strip line of the transmitting matching unit by a certain distance, so that first phase-adjusting capacitances are formed between the first ground electrode and the transmitting-side strip line.

19. The laminated duplexer according to claim 18, wherein the first inductance and the first phase-adjusting capacitances have electrical lengths set to transform a phase of a signal having a receiving frequency into infinite impedance, respectively.

20. The laminated duplexer according to claim 18, wherein the transmitting matching unit has characteristic impedance determined for a transmitting frequency by equivalent impedances of the first inductance, first capacitance, and first phase-adjusting capacitances.

21. The laminated duplexer according to claim 16, wherein the second conductor pattern of the receiving matching unit comprises:

a receiving-side capacitor electrode spaced apart from the antenna electrode by a certain distance to form a second capacitance for adjustment of characteristic impedance therebetween; and a receiving-side strip line extending from the receiving-side capacitor electrode to the receiving filter while having a bent shape, and forming a second inductance.

22. The laminated duplexer according to claim 21, wherein the second ground electrode is spaced apart from the receiving-side strip line of the receiving matching unit by a certain distance, so that second phase-adjusting capacitances are formed between the second ground electrode and the receiving-side strip line.

23. The laminated duplexer according to claim 22, wherein the second inductance and the second phase-adjusting capacitances have electrical lengths set to transform the phase of a signal having a transmitting frequency into infinite impedance, respectively.

24. The laminated duplexer according to claim 23, wherein the receiving matching unit has characteristic impedance determined for a receiving frequency by equivalent impedances of the second inductance, second capacitance, and second phase-adjusting capacitances.

* * * * *